US008622700B1

(12) United States Patent
Coffey

(10) Patent No.: US 8,622,700 B1
(45) Date of Patent: Jan. 7, 2014

(54) CEILING FAN, INCLUDING BLADES AND HARDWARE THAT INCORPORATES OR IS CONSTRUCTED OF PHOSPHORESCENT MATERIALS

(76) Inventor: Alan Robert Coffey, Newark, DE (US)

( * ) Notice: Subject to any disclaimer, the term of this patent is extended or adjusted under 35 U.S.C. 154(b) by 777 days.

(21) Appl. No.: 12/799,249

(22) Filed: Apr. 20, 2010

Related U.S. Application Data

(60) Provisional application No. 61/171,324, filed on Apr. 21, 2009.

(51) Int. Cl.
*F01D 5/12* (2006.01)

(52) U.S. Cl.
USPC ..... 416/5; 416/241 R

(58) Field of Classification Search
USPC ..... 416/5, 241 R
See application file for complete search history.

(56) References Cited

U.S. PATENT DOCUMENTS

| | | | | |
|---|---|---|---|---|
| 4,382,400 | A | 5/1983 | Stutzman | |
| 4,621,992 | A | 11/1986 | Angott | |
| 4,843,524 | A | 6/1989 | Krent et al. | |
| 5,028,206 | A | 7/1991 | Kendregan et al. | |
| 5,072,341 | A | 12/1991 | Huang | |
| 5,082,422 | A | 1/1992 | Wang | |
| 5,097,398 | A | 3/1992 | Dye | |
| 5,224,830 | A | 7/1993 | Wang | |
| 5,270,905 | A | 12/1993 | Trevino | |
| 5,292,228 | A | 3/1994 | Dye | |
| 5,302,083 | A | 4/1994 | Bucher et al. | |
| 5,437,540 | A | 8/1995 | Blocker et al. | |
| 5,672,002 | A | 9/1997 | Todd, Jr. et al. | |
| 5,934,783 | A | 8/1999 | Yoshikawa | |
| 6,018,479 | A | 1/2000 | Jeong | |
| 6,036,331 | A | 3/2000 | Aquisto | |
| 6,082,868 | A * | 7/2000 | Carpenter | 416/5 |
| 6,193,384 | B1 | 2/2001 | Stein | |
| 6,302,556 | B1 | 10/2001 | Filip | |
| 6,461,032 | B2 | 10/2002 | McKinley | |
| 6,802,635 | B2 * | 10/2004 | Robertson et al. | 362/555 |
| 6,851,821 | B2 | 2/2005 | Hsu | |
| 6,899,448 | B2 * | 5/2005 | Damalas | 362/404 |
| 7,036,949 | B2 | 5/2006 | Srass et al. | |
| 7,201,489 | B2 | 4/2007 | Shyu | |
| 7,477,030 | B2 | 1/2009 | Meckler et al. | |

(Continued)

FOREIGN PATENT DOCUMENTS

| | | |
|---|---|---|
| CN | 2 166 985 | 6/1994 |
| GB | 303870 | 4/1930 |

OTHER PUBLICATIONS

Disney Tinkerbell Glow in Dark Ceiling Fan Blades, kjscreations website; http://www.ecrater.com/product.php?pid=2813275; accessed on May 24, 2010.

*Primary Examiner* — Igor Kershteyn
(74) *Attorney, Agent, or Firm* — Law Office of Jeffrey R. Ramberg

(57) ABSTRACT

People, especially children, need a small amount of illumination to orient themselves and navigate around a darkened room. Children often have trouble calming themselves down at bedtime. Finding the fan and light controls on a ceiling fan is difficult in the dark. Ceiling fan blades and hardware that incorporate phosphorescent materials addresses each of these problems: they provide a night light effect without using electricity. They create pleasing and soothing artistic effects when the fan is rotating. Phosphorescent fan controls or illumination from other components of the invention with phosphorescent surfaces allow for easy navigation in a darkened room.

16 Claims, 2 Drawing Sheets

(56) References Cited

U.S. PATENT DOCUMENTS

| | | | |
|---|---|---|---|
| 2004/0027827 | A1 | 2/2004 | Currie et al. |
| 2004/0252495 | A1 | 12/2004 | Tseng |
| 2006/0120064 | A1 | 6/2006 | McElhannon |
| 2007/0009357 | A1 | 1/2007 | Solak |
| 2008/0064318 | A1 | 3/2008 | Wellner et al. |
| 2008/0213094 | A1 | 9/2008 | Okimura |

* cited by examiner

CEILING FAN, INCLUDING BLADES AND HARDWARE THAT INCORPORATES OR IS CONSTRUCTED OF PHOSPHORESCENT MATERIALS

CROSS-REFERENCE TO RELATED APPLICATIONS

This patent document claims the benefit of commonly owned U.S. Provisional Patent Application No. 61/171,324, filed on Apr. 21, 2009, in the name of Alan Robert Coffey and entitled "CEILING FAN, INCLUDING BLADES AND HARDWARE THAT INCORPORATES OR IS CONSTRUCTED OF PHOSPHORESCENT MATERIALS"

BACKGROUND OF THE INVENTION

1. Field of the Invention

The present invention relates to ceiling fans and to phosphorescent materials.

2. Discussion of Related Art

A prior art search revealed the following patents as possibly being relevant to the instant invention: U.S. Patent Application Publication No. 2004/0027827 to Currie et al., U.K. Patent No. GB 303,870 to Bertrand, and Chinese Patent Publication No. CN 2,166,985 to Li.

People, especially children, need a small amount of illumination to orient themselves and navigate around a darkened room. Current night lights are usually mounted low on the wall at the height of the electrical outlet. Current night lights frequently require electricity.

Children often have trouble calming themselves down at bedtime. Mobiles and other child calming devices require electricity and do not provide any additional utility as a fan. Mobiles and other child calming devices are not safely out of reach of older children.

Current ceiling fan designs generally do not provide the utility of a night light and where they could be equipped to do so, produce light using electricity. Finding the fan and light controls on a ceiling fan is difficult in the dark.

The present invention addresses each of these problems.

SUMMARY OF THE INVENTION

In accordance with aspects of the present invention, at least some of the visible components of a ceiling fan incorporate or are coated with, in whole or in part, one or more phosphorescent materials. Such a ceiling fan addresses each of the above-identified problems: it provides a night light effect without using electricity. It creates pleasing and soothing artistic effects when the fan is rotating. Phosphorescent fan controls or illumination from other components of the invention having phosphorescent surfaces allow for easy navigation in a darkened room.

Figure 1:
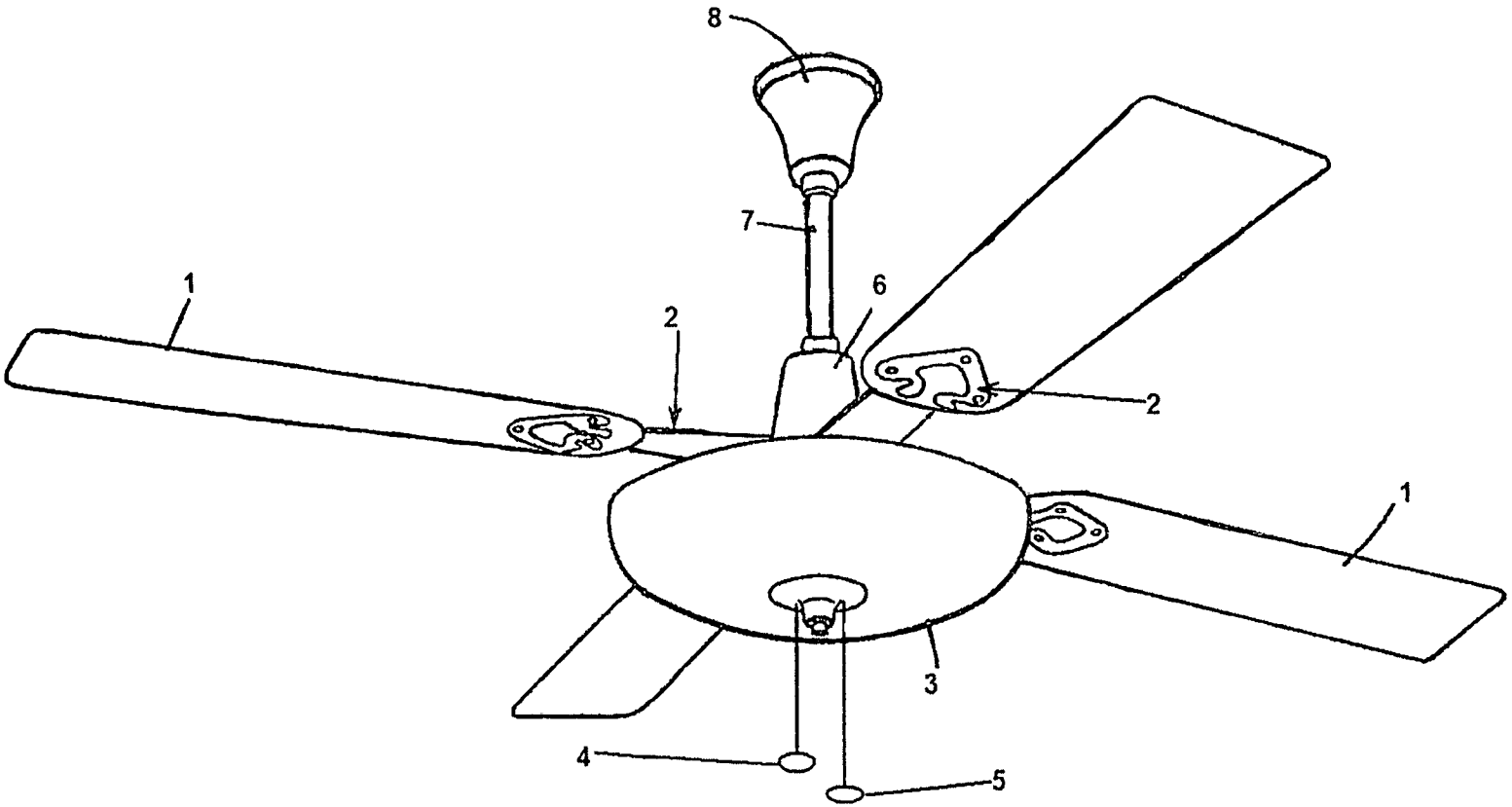
FIG. 1 is a perspective view of a ceiling fan mounted on a ceiling from the perspective of an observer positioned below the fan.

The numbers in the drawings correspond to the following parts:

1 fan blade
2 fan blade holder
3 shade or cover
4,5 pull chain or fob
6 housing
7 down rod
8 rod canopy

DETAILED DESCRIPTION OF THE INVENTION

The present invention relates to a ceiling fan, including blades and hardware that incorporates or is constructed of phosphorescent materials.

The inventive ceiling fan will now be described in detail.

Figure 2:
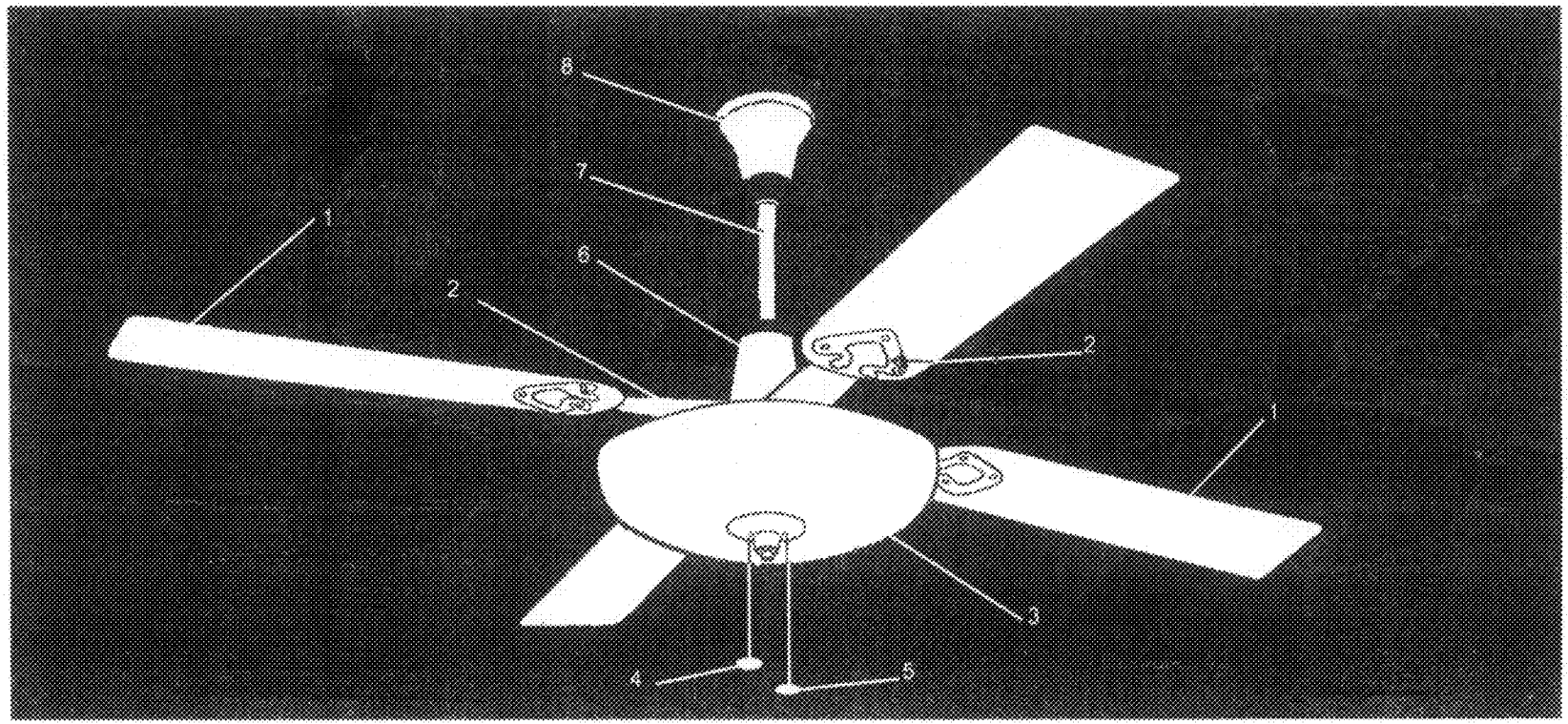
FIG. 2 is substantially the same view as FIG. 1, but in a darkened room and in which substantially all visible outer surfaces of the fan incorporate or have been coated with one or more phosphorescent materials.

An aspect of the invention features a ceiling fan that has its various outer surfaces, partially or in total, coated with or incorporating phosphorescent material. The surfaces, whether composed of, or coated with phosphorescent material provide illumination after exposure to the ambient light in the room, light from an attached ceiling fan light kit, or any other light source. Referring now to FIGS. 1 and 2, the outer surfaces of a typical ceiling fan may include, but are not limited to, the following components:

A Plurality of Radially Extending Blades

The fan blades (1) may be constructed of any material that incorporates phosphorescence. The blade may be constructed of various materials with differing phosphorescent properties, or with only some of the materials having the phosphorescent property. Alternatively, the blades' surfaces may be painted or otherwise coated with phosphorescent paint.

Blade Holders

Blade holders (2) secure the rotating blades to the rotating drive portion of the motor/housing assembly variously referred to as holders, irons or arms. The blade holders may be constructed of any material that incorporates phosphorescence. The blade holders may be constructed of various materials with differing phosphorescent properties, or with only some of the materials having the phosphorescent property. Alternatively, the blade holders' surfaces may be painted or coated with phosphorescent paints.

The Light Kit Bowl or Shade Assembly

A light kit bowl or shade assembly (3) may be illuminated by the phosphorescent components of the fan and/or be partially or completely coated with or constructed of phosphorescent material.

The Pull Chain and Fob

The pull chain and fob for the light control (4) may be constructed so as to move in the airflow of the fan to enhance the light/motion effects. The pull chain and fob for the fan control (5) may be constructed of any material that incorporates phosphorescence. The pull chain and fob may be constructed of various materials with differing phosphorescent properties or with only some of the materials having the phosphorescent property. Alternatively, the surfaces of the pull chain and fob may be painted with phosphorescent paint. If the ceiling fan is one that features separate fobs for the fan and light controls, they may be painted in different colors to distinguish one from the other in the dark. Alternatively, the fobs may be fabricated into different shapes, or the chain and fob for the light control may be left uncoated.

The Motor Housing

The motor housing (6) may be constructed of any material that incorporates phosphorescence. The motor housing may be constructed of various materials with differing phosphorescent properties, or with only some of the materials having the phosphorescent property. Alternatively, the surfaces of the motor housing may be painted with phosphorescent paint. This produces a strobe effect when viewed from below.

The Down Rod

The down rod (7) may be constructed of any material that incorporates phosphorescence. The down rod may be constructed of various materials with differing phosphorescent properties or with only some of the materials having the phosphorescent property. Alternatively, the surfaces of the down rod may be painted with phosphorescent paint.

The Mounting Canopy and Hardware

The mounting canopy or rod cover (8) may be of any diameter. The mounting canopy and hardware may be constructed of any material that incorporates phosphorescence. The mounting canopy and hardware may be constructed of various materials with differing phosphorescent properties, or with only some of the materials having the phosphorescent property. Alternatively, the surfaces of the mounting canopy and hardware may be painted with phosphorescent paint.

Any use of phosphorescent material on the surface of a ceiling fan would provide some night light effect. Using the phosphorescent material on the rotating parts adds a soothing effect when the fan is in motion. Combining elements of the rotating and non-rotating components increases the soothing artistic effect. Adding a phosphorescent fob to the fan control and light control chains adds the utility of ease of location in the dark. Adding a larger rod canopy may create strobe effects when viewed below.

Utilizing a bowl shaped (open topped) light shade kit allows for more of the light emitted by the electric light kit to charge the phosphorescent material. Utilizing a spotlight type light kit allows the inner surface of the light shades to utilize phosphorescent material.

Ceiling fans feature three sections: (A) the rotational components including the fan blades (1) and holders (2), (B) the motor and mounting components above the rotational components including the housing (6), down rod (7) and rod canopy (8), and (C) the light kit and mounting components below the rotational components including the light kit (3), shades (3), covers (3), pull chains (4,5) and fobs (4,5). Here, the terms "above" and "below" are taken with respect to a person or observer standing on the floor with the ceiling fan mounted on the ceiling.

The components above the rotational components can act as a background for the rotational components when viewed from below. The light emitted by these components when phosphorescing will be periodically interrupted by the rotating fan blades (1) when the blades are in motion. This produces a strobe effect. A larger diameter canopy (8) provides a larger background against which the fan blades are seen to move. The motor housing (6) and down rod (7) may have the fan blades between the component and the viewer.

The components in the light kit are not necessarily static, but the light emitted by phosphorescent components in this category will not be interrupted by the rotating blades.

The rotational components produce more interesting effects when combined with phosphorescence in other components.

Various combinations of colors and materials between and within the component groups can create a wide variety of light effects.

Phosphorescence and fluorescence are specific types of photoluminescence, a phenomenon whereby a material absorbs radiation and re-emits it at a lower wavelength. Unlike fluorescence, a phosphorescent material does not immediately re-emit the radiation it absorbs. The slower time scales of the re-emission are associated with "forbidden" energy state transitions in quantum mechanics. As these transitions occur less often in certain materials, absorbed radiation may be re-emitted at a lower intensity for up to several hours.

The rate of emission of photons, brightness, decreases over time in phosphorescent material. This degradation allows the present ceiling fan to emit more light over a wider color spectrum at the time a child would be going to sleep right after the lights have been turned off in the room. A night adapted eye in the room will still be able to easily navigate the room with the light emitted from the phosphorescent material even 8 hours after light charging. Locating the phosphorescent material in the center of the room allows for even light dispersal.

The night light effect is enhanced by increasing the phosphorescent area. The fan blades, light bowls, motor housing and rod canopy offer the most surface area in most embodiments of the ceiling fan. Using these surfaces to provide most of the lighting and accentuating the effect with alternate colors of phosphorescence in other components enhances the soothing, entertaining and artistic effects. The surfaces may have phosphorescent material applied to the outside. This allows the use of geometric and other stylistic designs that present one image in the presence of externally provided illumination, and a completely different image when glowing in the absence of such an external light source.

Using phosphorescent surfaces in all of the components would create a very bright night light. Using phosphorescent materials in the pull chain fobs would allow a user to find the fob in the dark. Using varying phosphorescent materials and colors allows for an artistic expression in motion and light.

The simplest way to make the inventive ceiling fan is to use phosphorescent paint to coat the various surfaces of a standard ceiling fan.

Alternative implementations of a phosphorescent ceiling fan may include, but are not limited to:

- Inlaying phosphorescent material in the fan blades.
- Filling open spaces in the fan holder/arm assemblies with phosphorescent material.
- Casting the glass globe of the lighting kit with phosphorescent material in the glass.
- Constructing the fobs for fan and light control chains from acrylic or other suitable material that has been impregnated with phosphorescent material.

Phosphorescent material can be made to reflect different colors when exposed to light than those it emits when not exposed to light. This can cause an effect similar to "day-glo" or fluorescent paint under illumination.

Exposing the invention to light for some time prior to extinguishing the light source will allow it to perform its minimum night light function in a darkened room.

Light exposure in a room with limited ambient lighting may be facilitated by the light kit attached to the ceiling fan itself. Generally speaking, it is not necessary to have additional artificial lighting external to the ceiling fan apparatus for charging the phosphorescent materials. Although compact fluorescent bulbs do a better and/or faster job of charging than do incandescent bulbs, the latter are still adequate.

In an alternate embodiment, an entertaining and even artistic way to charge some or all of the phosphorescent materials of the ceiling fan is for a person to shine a flashlight onto these materials in an uncharged state, thereby charging them. On components capable of rotating, the materials may be rotating during the charging, or afterwards, or both. Flashlights having light emitting diodes (LEDs) as their light source provide a high intensity beam that does a good job of charging such phosphorescent materials. It may be possible to adjust the intensity of the beam if one is able to adjust the width or narrowness of the beam emanating from the flashlight. A laser pointer can provide a very narrow beam of light. In this hand-held light source embodiment, one is able to "paint" a design of one's choice on the phosphorescent materials.

The more soothing aspects of the invention require the fan motor to be rotating the fan blades.

In the darkened room, a phosphorescent fob on the fan or light chains may be used to easily locate these controls. For fans without such fobs, the control typically is provided either by a wall mounted switch, or a remote control unit, both of which can incorporate or be coated with phosphorescent materials for the convenience of their being located in the dark.

The embodiments of the invention allows a parent to enter a child's room even some time after the light has been extinguished and easily navigate obstacles.

While I have focused on the use of the invention in a child's room, there are other uses as well.

In an industrial setting the phosphorescent ceiling fan would be a safety item. The central location of fans along with the large available surface for phosphorescence makes it an ideal illumination device during power outages and other light interruption events.

There is a significant artistic opportunity encompassed by the present embodiments of this invention. Artists may adapt this to use in adults bedrooms as well as in other rooms in the house for entertainment and display purposes.

Moreover, the present embodiments permit a ceiling fan to additionally function as a night light but without drawing electrical current as current nightlights do. Thus, the present embodiments of the invention save energy.

An artisan of ordinary skill will appreciate that various modifications may be made to the invention herein described without departing from the scope or spirit of the invention as defined in the appended claims.

What is claimed is:

1. A blade for a ceiling fan, said blade incorporating or constructed of phosphorescent materials, said ceiling fan being arranged for attachment to a ceiling.

2. A ceiling fan comprising at least one fan blade and at least one non-rotating component, wherein each of said blade and non-rotating component incorporates or is coated with at least one phosphorescent material, said ceiling fan further comprising hardware arranged for mounting to a ceiling of a room of a building.

3. The ceiling fan of claim 2, further comprising at least one rotating component other than said at least one fan blade that incorporates or is coated with at least one phosphorescent material.

4. The ceiling fan of claim 3, wherein said non-rotating components comprise components located above said rotating components, and components located below said rotating components.

5. The ceiling fan of claim 3, wherein at least one of said rotating components incorporates or is coated with at least one phosphorescent material on substantially all of its visible surfaces.

6. The ceiling fan of claim 3, wherein at least one of said rotating components incorporates or is coated with at least one phosphorescent material on less than all of its visible surfaces.

7. The ceiling fan of claim 6, wherein said at least one phosphorescent material is arranged as an artistic design.

8. The ceiling fan of claim 3, wherein at least one of said non-rotating components incorporates or is coated with at least one phosphorescent material on substantially all of its visible surfaces.

9. The ceiling fan of claim 3, wherein at least one of said non-rotating components incorporates or is coated with at least one phosphorescent material on less than all of its visible surfaces.

10. The ceiling fan of claim 3, further comprising at least two phosphorescent materials that glow in different colors.

11. The ceiling fan of claim 10, wherein each of said at least two phosphorescent materials is incorporated into or coated onto a different component.

12. The ceiling fan of claim 10, wherein each of said at least two phosphorescent materials is incorporated into or coated onto the same component.

13. The at ceiling fan of claim 2, further comprising at least one other component that incorporates or is coated with at least one phosphorescent material, said at least one other component selected from the group consisting of a blade holder, a shade, a cover, a pull chain, a fob, a housing, a down rod, and a rod canopy.

14. In a ceiling fan, at least one blade holder for attaching a fan blade to a rotating drive portion of a motor/housing assembly, said blade holder comprising at least one phosphorescent material on at least one visible surface, said ceiling fan being arranged for mounting to a ceiling.

15. The at least one blade holder of claim 14, further comprising at least one fan blade arranged to be attached to said blade holder.

16. The at least one blade holder of claim 15, wherein said at least one fan blade incorporates or is coated with at least one phosphorescent material on at least a portion of at least one visible surface.

* * * * *